US006125950A

United States Patent [19]

Osborne

[11] Patent Number: 6,125,950

[45] Date of Patent: Oct. 3, 2000

[54] COLLARED BORING BIT

[76] Inventor: Joseph D. Osborne, 4225 Thom, Columbiaville, Mich. 48421

[21] Appl. No.: 09/211,326

[22] Filed: Dec. 15, 1998

[51] Int. Cl.[7] ..... E21B 7/04; E21B 7/08

[52] U.S. Cl. ..... 175/73; 175/398; 175/400; 175/435

[58] Field of Search ..... 175/19, 21, 61, 175/67, 73, 398, 399, 400, 435

[56] References Cited

U.S. PATENT DOCUMENTS

| | | | |
|---|---|---|---|
| 1,030,387 | 6/1912 | Critton . | |
| 1,893,033 | 1/1933 | Murdock et al. . | |
| 2,350,986 | 6/1944 | Collins | 175/400 X |
| 2,689,131 | 9/1954 | Priest . | |
| 3,668,877 | 6/1972 | Fuentes, Jr. . | |
| 4,993,503 | 2/1991 | Fischer et al. | 175/73 X |
| 5,020,608 | 6/1991 | Oden et al. . | |
| 5,148,880 | 9/1992 | Lee et al. | 175/398 X |
| 5,242,026 | 9/1993 | Deken et al. | 175/19 |
| 5,695,014 | 12/1997 | Jenne | 175/21 |
| 5,794,719 | 8/1998 | Holloway . | |

OTHER PUBLICATIONS

Ditch Witch® Jet Trac® Directional Boring System Catalog of the Charles Machine Works, Inc. Perry, OK 73077; undated.

Directional Depot Spring '98 Catalog of Directional Depot, La Mirada, CA 90637; Dated: Spring of 1998.

Directional Boring Accessories Catalog of Vermeer Manufacturing Co., Pella, Iowa 50219; Dated: 1997.

*Primary Examiner*—David Bagnell
*Assistant Examiner*—Jong-Suk Lee
*Attorney, Agent, or Firm*—Young & Basile, PC

[57] ABSTRACT

A collared boring bit which interfaces with a boring head whereby shear forces developed during a boring operation are transmitted through the collar to the boring head, with minimal shear force being carried by the bolts. A bit collar is welded to a boring bit, wherein a head receptacle formed collectively of the bit collar and the boring bit seatably receives a boring head with substantially close clearance so that shear forces during boring operations are transmitted from the boring bit to the boring head through the bit collar. The preferred bit collar is fabricated from a pipe section, such as for example steel seamless pipe. A bit recess is cut for interfacing with a boring bit at the head face connection thereof. A head recess is cut opposite the bit recess for providing an exit for the water spray from the nozzle thereof. Both the bit recess and the head recess converge toward and communicate with a forward end of the pipe section, whereat a brace is welded transversely to interconnect the remaining left and right pipe components to thereby form the bit collar. It is preferred for carbide weld beads to be crisscrossingly placed upon the outer surface of the bit collar, as well as along the periphery of the head recess, to thereby add resistance to wear.

18 Claims, 4 Drawing Sheets

COLLARED BORING BIT

BACKGROUND OF THE INVENTION

1. Field of the Invention

The present invention relates to directional boring systems, and more particularly to the boring head to boring bit interface thereof. More particularly, the present invention relates to a collared boring bit which interfaces with a boring head to thereby provide high resistance to shearing forces developed during a boring operation.

2. Description of the Prior Art

Directional boring has become increasingly important for the installation of underground cables, such as for example electric, cable television, and telephone cables.

An example of a prior art directional boring system 10 is shown (in part) at FIGS. 1 and 2, wherein a spindle drive of a directional boring apparatus 12 serves to rotate and push drill pipe 14 into the ground G. As best shown at FIG. 2, at the end of the drill pipe 14 is a threadably mounted boring head 16 and a boring bit 18 connected to the boring head by bolts 20. The boring head 16 has a bit connection face 22 which has an acute angle A' with respect to the pipe axis P. The boring bit 18 may have various shapes for cutting into soil, wherein a head connection face 24 is configured to restably mate with the bit connection face 22 of the boring head 16.

The drill pipe is hollow and is connected to a supply of high pressure water from the directional boring apparatus 12. The boring head 16 has an interior hollow which communicates with a hollow threaded shank 16*a* thereof. The boring head 16 further has an nozzle 26 through which the high pressure water from the directional boring apparatus 12 exits. The boring bit 16 is provided with carbide hard-facing 28 at the cutting edges for providing enhanced abrasion resistance during boring operations.

In operation of a directional boring system, the directional boring apparatus 12 forces the boring bit 18 into the ground G. The high pressure water serves to open the ground and help make way for the advancement of the boring bit and its associated boring head. The acute angle of the boring bit is adjusted relative to the ground (it is now not rotating) so that the boring head descends to a predetermined depth and then attains a horizontal attitude. The drill pipe 14 is now caused to rotate and with the advancement force supplied by the directional boring apparatus on the drill pipe, along with the high pressure water stream from the nozzle, the drill pipe advances underground along a predetermined path at the predetermined depth. More drill rods are added to assure sufficient drill pipe for the job, which can exceed a drill path length of 300 feet. When the end of the path is approaching, the drill pipe is again stopped from rotating and the acute angle of the boring bit is adjusted to cause further advancement to result in ascension until the boring head breaks ground. Now, a hook is installed on the boring bit and the directional boring apparatus now pulls back the drill pipe, wherein the cable is attached to the hook and is fed into the underground passage made by the drilling operation.

Thrust supplied by the directional boring apparatus can reach 17,000 pounds and the rotation speed of the boring bit can reach 200 revolutions per minute. Although the water flow rate out the nozzle can reach 700 pounds per square inch at a flow rate of up to 25 gallons per minute, the boring bit is subjected to extreme shear force as it rotatively cuts into soils. When rocky, hard soils are encountered, such as glacial till soil, the boring bit can be subjected to shearing shock forces. Whatever the source, shearing forces tend to dislodge the boring bit from the boring head. Since only the bolts secure the boring bit to the boring head, these bolts must resist these shearing forces. No matter whether three, six, eight or more bolts are used, the bolts eventually will break, usually unpredictably, and always with great waste of time and expense for the directional boring system operator.

Accordingly, what remains needed in the art is an interface for a boring bit to a boring head, wherein shear force to the bolts is relieved.

SUMMARY OF THE INVENTION

The present invention is a collared boring bit which interfaces with a boring head whereby shear forces developed during a boring operation are transmitted between the boring head and the boring bit via a bit collar, with minimal shear force being carried by the bolts.

The collared boring bit according to the present invention has a ground cutting configuration of a selected geometry known in the art, as well as a conventional head connection face. A bit collar is welded to the boring bit, wherein the bit collar and the head connection face of the boring bit collectively form a head receptacle for seatably receiving therein a boring head with substantially close clearance (ie., a snug mutual fit) so that shear forces during boring operations are transmitted through the bit collar between the boring bit and the boring head.

The preferred bit collar is fabricated from a pipe section, such as for example steel seamless pipe. A bit recess is cut for interfacing with a boring bit at the head face connection thereof. A head recess is cut opposite the bit recess for providing an exit for the water spray from the nozzle thereof. Both the bit recess and the head recess converge toward and communicate with a forward end of the pipe section, whereat, preferably, a brace is welded transversely to interconnect the remaining left and right pipe components (the rear end of the pipe remains fully intact) to thereby form the bit collar. It is preferred for carbide weld beads to be crisscrossingly placed upon the outer surface of the bit collar, as well as along the periphery of the head recess, to thereby add resistance to wear.

In operation, a boring bit is placed into the bit recess and welded to the bit collar to thereby provide a collared boring bit. A boring head is then inserted through the rear end of the bit collar into the head receptacle until the bit connection face mates with the head connection face. The boring head is next bolted to the boring bit. Now the collared boring bit and boring head connected thereto may be used to provide ground borings with a conventional directional boring apparatus.

Accordingly, it is an object of the present invention to provide a bit collar for a boring bit for transmitting therethrough shear forces between the boring bit and a boring head during a boring operation.

It is an additional object of the present invention to provide a collared boring bit which minimizes shear stress on bolts mounting the boring bit to a boring head.

It is another object of the present invention to provide a collared boring bit which serves to transmit shear forces between the boring bit and a boring head and to protect the boring head from abrasion during a boring operation.

These, and additional objects, advantages, features and benefits of the present invention will become apparent from the following specification.

DETAILED DESCRIPTION OF THE PREFERRED EMBODIMENT

Referring now to FIGS. 3 through 10 the collared boring bit 100 according to the present invention will be detailed.

Figure 1:
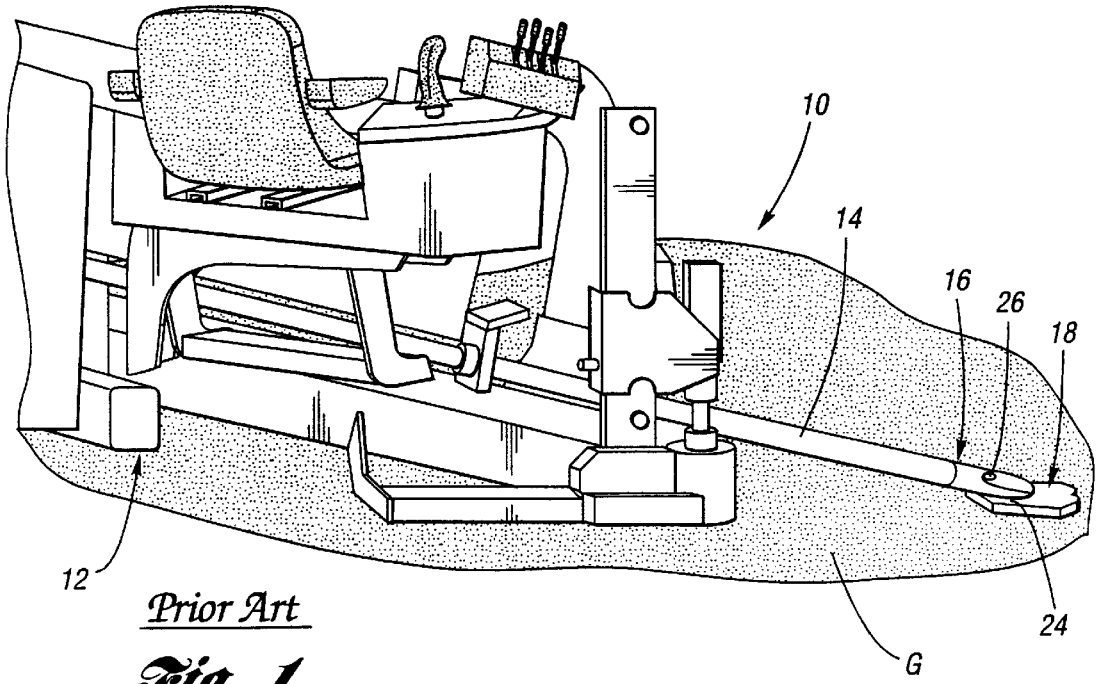
Prior Art Fig. 1
FIG. 1 is a broken-away, perspective view of a prior art directional boring system.
Figure 2:
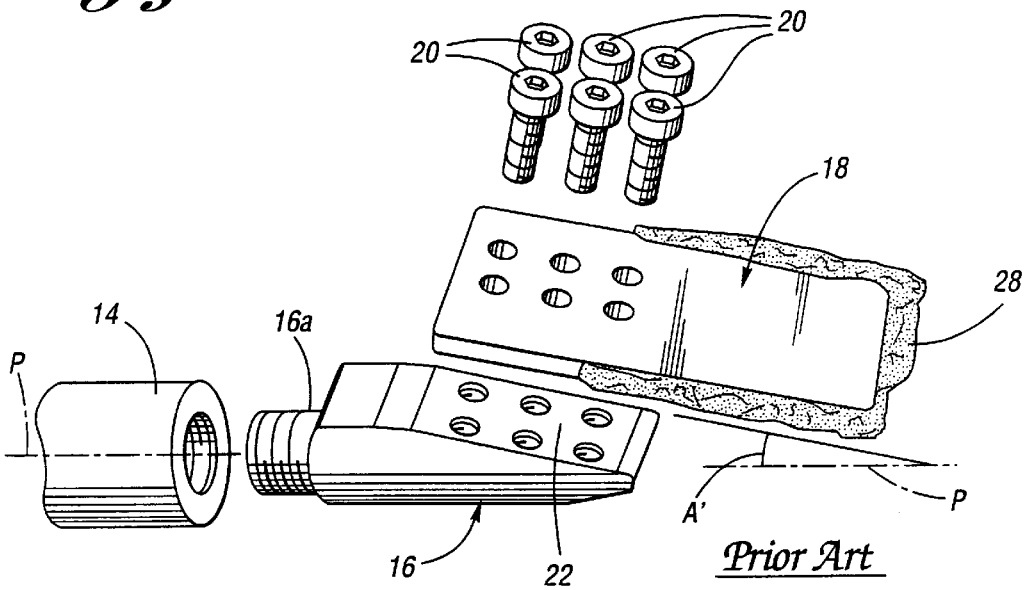
Prior Art Fig. 2
FIG. 2 is an exploded perspective view of a prior art boring head, boring bit and the bolts which serve as a threaded connection media therebetween.
Figure 3:
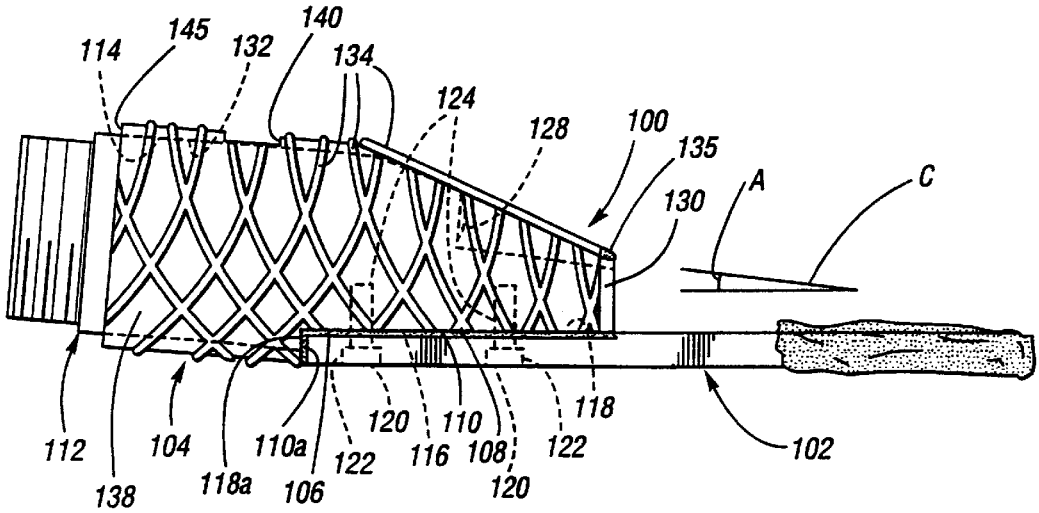
FIG. 3 is a side view of a collared boring bit according to the present invention, shown in operation with a boring head.
Figure 4:
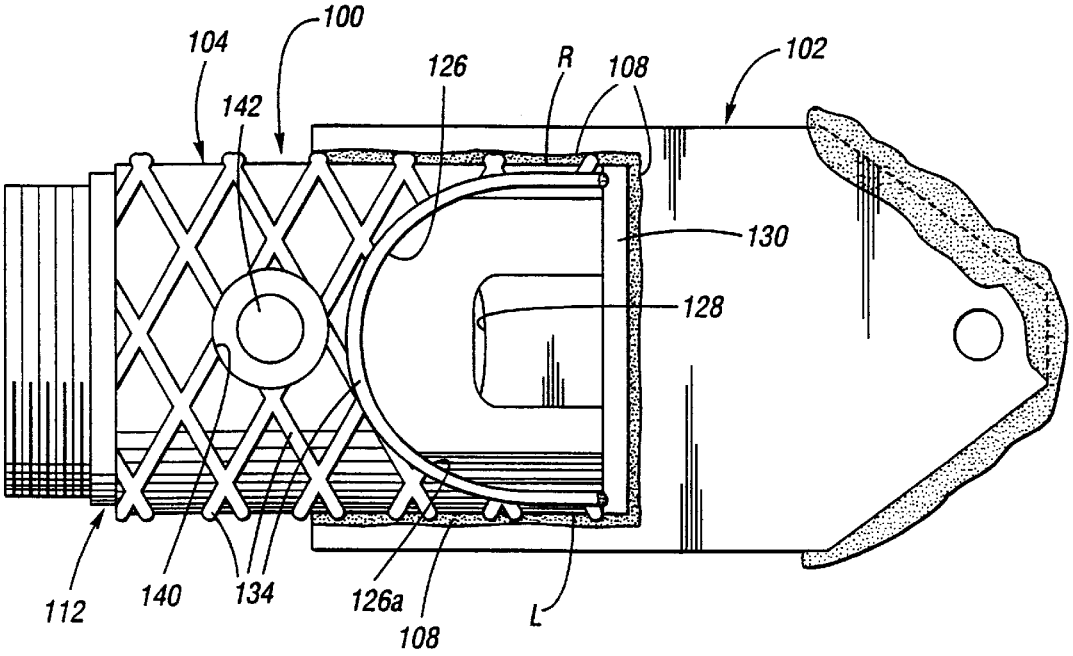
FIG. 4 is a top plan view of the collared boring bit and boring head of FIG. 3.
Figure 5:
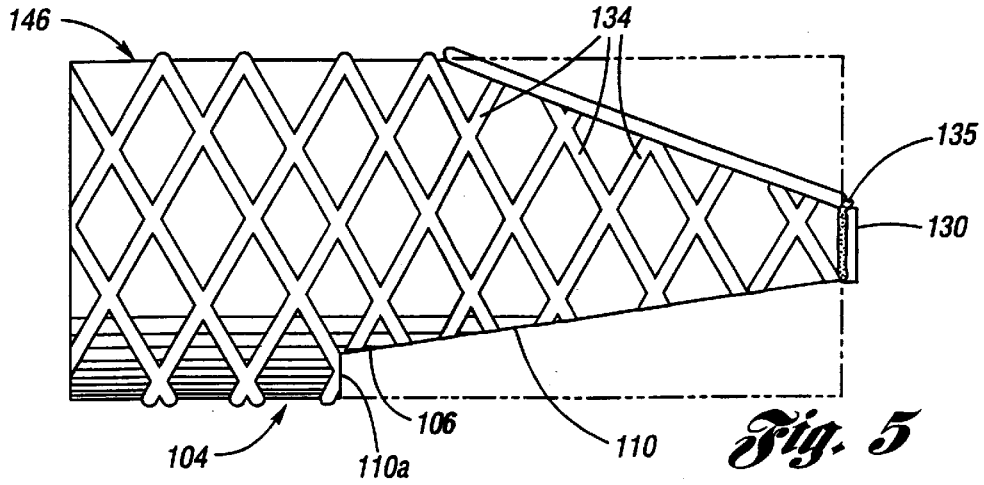
FIG. 5 is a side view of a bit collar according to the present invention.
Figure 6:
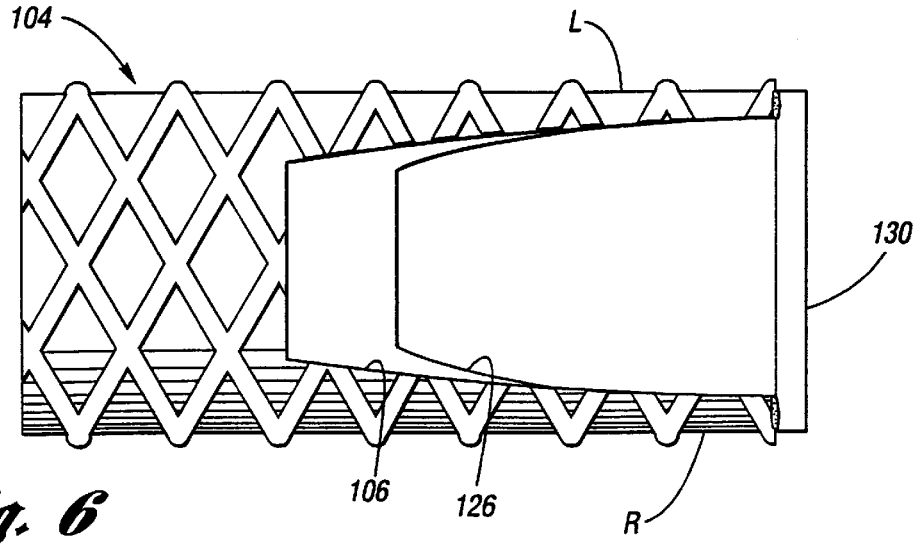
FIG. 6 is a bottom plan view of the bit collar of FIG. 5.
Figure 7:
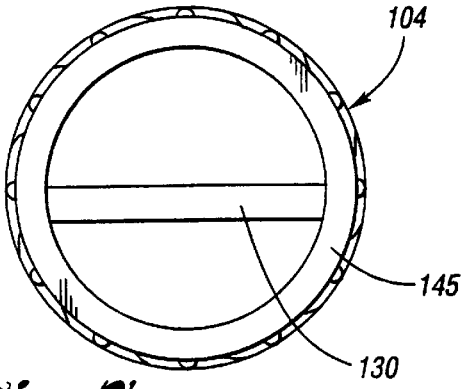
FIG. 7 is a rear end view of the bit collar of FIG. 5.
Figure 8:
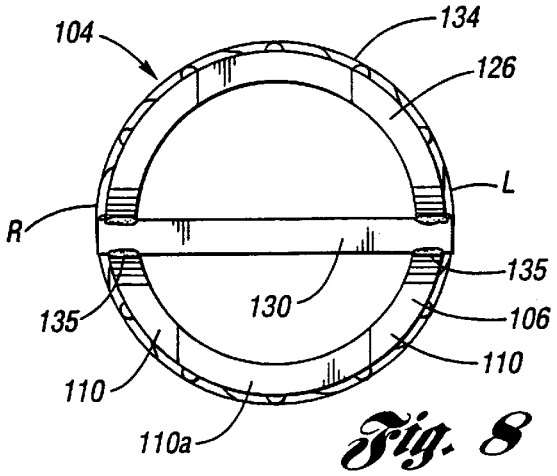
FIG. 8 is a forward end view of the bit collar of FIG. 5.

As shown at FIGS. 3 and 4, the collared boring bit 100 includes a boring bit 102 and a bit collar 104 which is welded to the boring bit. In this regard, the bit collar 104 is provided with a bit recess 106 into which the boring bit 102 seats, and wherein the welding 108 is provided along the periphery 110 of the bit recess. The periphery 110 is cut at a predetermined acute angle A with respect to the collar axis C, wherein the angle A is selected to be equal to the acute angle of the bit connection face 116 of a boring head 112 (see for example FIG. 2). The terminus 110*a* of the periphery is located to abut the end 118*a* of the head connection face 118.

The bit collar 104 covers the head connection face 118 of the boring bit 102. The bit collar 104 and the head connection face 118 cooperate to form a head receptacle 114, wherein the boring head 112 snugly fits therein.

The boring head 112 is seatably received into the head receptacle 114 whereupon its bit connection face 116 interfaces conventionally with the head connection face 118 of the boring bit 102. Bolts 120 are used to affixedly secure the boring bit 102 to the boring head 112 via bolt holes 122 in the boring bit and aligned threaded holes 124 in the boring head.

The bit collar 104 further has a head recess 126 formed opposite the bit recess 106, wherein the nozzle 128 of the boring head 112 is fully exposed for the purpose of allowing water under pressure to spray therefrom without encumbrance.

Since the head recess 126 and the bit recess 106 converge toward, and communicate with, the forward end 135 of the bit collar 104, it is preferred for a brace 130 to transversely span the forward end, thereby serving to rigidify the forward end of the bit collar, as well, optionally, as serving to alignably abutment for the boring head 112 when it is inserted into the head receptacle 114. Welding 108 secures the brace 130 to the left and right components, L, R of the bit collar, as well as to the boring bit 102.

The interior wall surface 132 of the bit collar 104 is shaped to seatably receive the shape of the boring head with little play (snug fit) therebetween, as for example telescoping, generally cylindrical shapes.

It is preferred to provide a plurality of carbide weld beads 134 upon the exterior surface 138 of the bit collar 104, as well as along the periphery 126*a* of the head recess 126. An example of placement of the carbide weld beads 134 is a crisscross pattern. The purpose of the carbide weld beads 134 is to provide the exterior surface 138 of the bit collar with resistance to wear during drilling operations.

An aperture 140 may optionally be provided in the bit collar 104 so that a boring head equipped with a fusable plug 142 may operate without fetter. In this regard, if the nozzle 128 should become plugged, excessive heat opens the fusable plug 142 and allows water to flood therefrom so as to serve as a coolant and facilitate continued boring. The aperture 140 serves as a port through which this coolant water from the fusable plug 142 is able to freely pass out of the bit collar 104.

In operation, a bit collar 104 is fabricated (as for example according to the method described hereinbelow), and is welded to a boring bit 102 to thereby provide a collared boring bit 100. A boring head 112 is placed into the rear end 145 of the bit collar, whereupon it is seatably received into the head receptacle 114 until bit connection face 116 of the boring head interfaces conventionally with the head connection face 118 of the boring bit 102. Bolts 120 are used to affixedly secure the boring bit 102 to the boring head 112 via bolt holes 122 in the boring bit and aligned threaded holes 124 in the boring head. Now, drill pipe is threadably engaged with the boring head and a directional boring apparatus is utilized to cause the boring bit to enter into the ground and provide a desired passage therethrough underground.

During operation of the directional boring apparatus, the drill pipe is caused to rotate, whereby the boring head transmits this rotation to the boring bit. As the boring bit cuts into various soils, resistance to this rotation develops. Accordingly, shear force between the boring bit and the boring head is present, which at times may be extreme enough to break the bolts if the bit collar was not present. However, the bit collar serves to transmit the shear forces between the boring head and the boring bit without breakage of the bolts. This is because the bit connection surface 116 of the boring head 112 is prevented from lifting away from the head connection surface 118 of the boring bit 102 by abutment of the boring head with interior wall surface 132 of the bit collar 104 due to the snug fit of the boring head in the head receptacle 114. Indeed, because of the snug interfit between the boring head 112 and the bit collar 104, the boring head will cause the boring bit 102 to rotate therewith even in the face of boring through glacial till soil even if no bolts are present.

Further, since boring heads are quite expensive, the bit collar will advantageously serve to protect the boring head from wear. Accordingly, the life of a boring head is now extended beyond the life a number of boring bits.

FIGS. 5 through 8 depict a preferred method of fabrication of the bit collar 104.

A pipe section 146 (shown in solid and dashed lines at FIG. 5), such as for example steel seamless pipe, is provided. The bit recess 110 is cut therein. The head recess 126 is cut therein opposite the bit recess. Both the bit recess and the head recess converge toward and communicate with the forward end of the pipe section (which is generally synonomous with the forward end 135 of the bit collar), whereat the brace 130 is welded transversely to interconnect the remaining left and right pipe components L, R, to thereby form the bit collar 104. An arc or gas welding unit is then utilized to place the carbide weld beads 134 crisscrossingly onto the outer surface of the bit collar, as well as along the periphery of the head recess, to thereby add resistance to wear.

Figure 9:
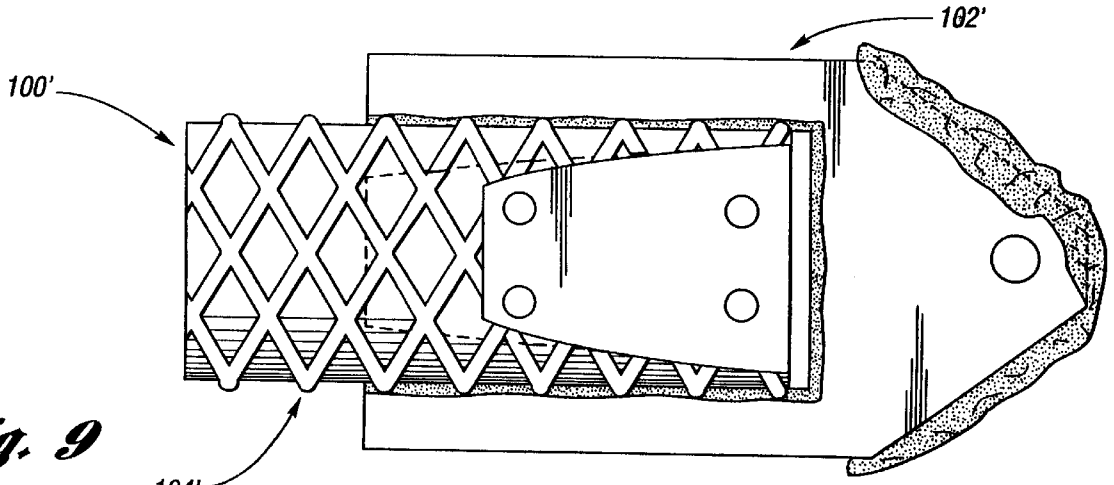
FIGS. 9 and 10 depict top plan views of exemplary collared boring bits according to the present invention.
Figure 10:
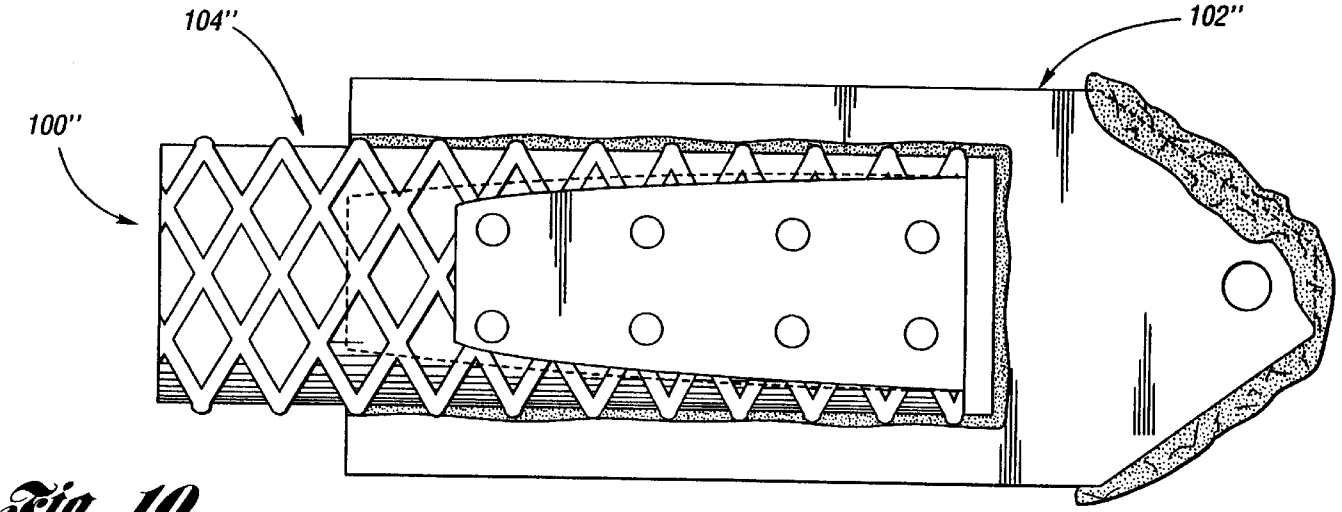

FIGS. 9 and 10 demonstrate possible configurations of the boring bit 102', 102" and the bit collar 104', 104" of respectively differingly sized collared boring bits 100', 100" which respectively accommodate differingly elongated boring heads.

To those skilled in the art to which this invention appertains, the above described preferred embodiment may be subject to change or modification. Such change or modification can be carried out without departing from the scope of the invention, which is intended to be limited only by the scope of the appended claims.

What is claimed is:

1. A collared boring bit for being interfaced with a boring head of a directional boring system, comprising:

a boring bit having a head connection face; and a bit collar fixedly connected to said boring bit, said bit collar and said head connection face collectively forming a head receptacle;

wherein said head receptacle is dimensioned to permit the boring head to be seated therein and be thereupon connected with said head connection face of said boring bit, wherein said bit collar has a collar axis and a bit recess having a bit recess periphery oriented at a predetermined acute angle with respect to the collar axis, and wherein said boring bit is seatably received by said bit recess at said bit recess periphery.

2. The collared boring bit of claim 1, wherein said bit collar further comprises wear resistant bead means for providing resistance to surface wear.

3. The collared boring bit of claim 1, wherein said bit collar further has an aperture formed therein for being aligned with a fusable plug of the boring head when the boring head is seated in the head receptacle.

4. A collar boring bit for being interfaced with a boring head of a directional boring system, comprising:

a boring bit having a head connection face;

a bit collar fixedly connected to said boring bit, said bit collar and said head connection face collectively forming a head receptacle, said head receptacle dimensioned to permit the boring head to be seated therein and be thereupon connected with said head connection face of said boring bit; and said bit collar having a head recess formed opposite said boring bit;

said head recess adapted to expose a nozzle of the boring head when the boring head is seated in said head receptacle.

5. The collared boring bit of claim 4, wherein said head receptacle has a predetermined geometry;

wherein said predetermined geometry provides for the boring head to be snugly seatably receivable into said head receptacle.

6. The collared boring bit of claim 5, wherein said bit collar has a collar axis and a bit recess having a bit recess periphery oriented at a predetermined acute angle with respect to the collar axis, and wherein said boring bit is seatably received by said bit recess at said bit recess periphery.

7. The collared boring bit of claim 6, wherein said bit collar further comprises a brace transversely connected thereto at a forward end thereof.

8. The collared boring bit of claim 7, wherein said bit collar further comprises wear resistant bead means for providing resistance to surface wear.

9. The collared boring bit of claim 8, wherein said bit collar further has an aperture formed therein for being aligned with a fusable plug of the boring head when the boring head is seated in the head receptacle.

10. A collar for a boring bit, wherein the boring bit is structured for being interfaced with a boring head of a directional boring system, comprising:

a bit collar having a forward end, an opposite rear end and a collar axis, said bit collar further having a bit recess and a head recess located opposite said bit recess and defining a head receptacle for receiving and surrounding a boring head, wherein said head and bit recesses mutually converge toward and communicate with said forward end; and a brace transversely oriented at said forward end;

wherein said bit recess has a periphery which has a predetermined acute angle with respect to the collar axis.

11. In a boring bit and boring head combination for being used in a directional boring system, the improvement comprising:

a boring head having a bit connection face and a nozzle, said bit connection face being oriented at a predetermined acute angle;

a boring bit having a head connection face;

connection means for threadably connecting said head connection face to said bit connection face; and a bit collar fixedly connected to said boring bit, said bit collar and said head connection face collectively forming a head receptacle;

wherein said head receptacle is dimensioned to permit the boring head to be seatably received therein, wherein when said boring head is seatably received in said head receptacle, the bit connection face thereof is connectable with said head connection face of said boring bit via said connection means; and wherein said head receptacle has a predetermined geometry wherein said boring head is snugly receivable by said head receptacle.

12. The improvement of claim 11, wherein said bit recess has a bit recess periphery oriented at said acute angle, and wherein said boring bit is seatably received by said bit recess at said bit recess periphery.

13. The improvement of claim 12, wherein said bit collar has a head recess formed opposite said boring bit;

wherein when said boring head is seatably received in said head receptacle, a nozzle of the boring head is exposed at said head recess.

14. The improvement of claim 13, wherein said bit collar further comprises a brace transversely connected thereto at a forward end thereof.

15. The improvement of claim 14, wherein said bit collar further comprises wear resistant bead means for providing resistance to surface wear.

16. The improvement of claim 15, wherein said boring head has a fusable plug; wherein said bit collar further has an aperture formed therein for being aligned with the fusable plug of the boring head when the boring head is seated in the head receptacle.

17. The improvement of claim 11, wherein said bit collar further comprises wear resistant bead means for providing resistance to surface wear.

18. The improvement of claim 11, wherein said boring head has a fusable plug; and wherein said bit collar further has an aperture formed therein for being aligned with the fusable plug of the boring head when the boring head is seated in the head receptacle.

* * * * *